US006071163A

United States Patent [19]

Chang et al.

[11] Patent Number: 6,071,163

[45] Date of Patent: Jun. 6, 2000

[54] WEAR-RESISTANT SPARK PLUG ELECTRODE TIP CONTAINING PLATINUM ALLOYS, SPARK PLUG CONTAINING THE WEAR-RESISTANT TIP, AND METHOD OF MAKING SAME

[75] Inventors: Chin-Fong Chang, Morris Plains, N.J.; Richard Dale Taylor; Lee Randall Franz, both of Findlay, Ohio; Edgar Arnold Leone, Randolph; Alex Kozlov, Wharton, both of N.J.

[73] Assignee: AlliedSignal Inc., Morristown, N.J.

[21] Appl. No.: 09/264,268

[22] Filed: Mar. 8, 1999

Related U.S. Application Data

[63] Continuation-in-part of application No. 09/114,425, Jul. 13, 1998, and a continuation-in-part of application No. 09/114,448, Jul. 13, 1998, Pat. No. 5,980,345.

[51] Int. Cl.[7] ..... H01T 13/20

[52] U.S. Cl. ..... 445/7; 313/118; 313/141

[58] Field of Search ..... 445/7; 313/141, 313/142, 118

[56] References Cited

U.S. PATENT DOCUMENTS

| | | | |
|---|---|---|---|
| 3,548,239 | 12/1970 | Eaton . | |
| 4,540,910 | 9/1985 | Kondo et al. | 313/141 |
| 4,699,600 | 10/1987 | Kondo . | |
| 4,743,793 | 5/1988 | Yoya et al. | 313/141 |
| 4,840,594 | 6/1989 | Moore . | |
| 5,557,158 | 9/1996 | Kanao et al. | 313/141 |

*Primary Examiner*—Kenneth J. Ramsey

[57] ABSTRACT

A wear-resistant electrode tip for a spark plug, and a spark plug which incorporates the wear-resistant tip. The wear-resistant tip includes an alloy of platinum, iridium, and tungsten. Surprisingly, by addition of a small amount of tungsten to platinum-iridium alloy, the wear-resistance of a resultant spark plug is greatly improved. The spark plug electrode tip according to the invention is either spherical or rivet-shaped. During manufacture, the spark plug electrode tip is annealed in an annealing furnace. The annealing furnace is preferably either charged with an inert gas such as argon or nitrogen, or is subjected to a vacuum. The electrode tip is, optionally, further externally coated with platinum or a compatible bonding metal alloy before attachment to the electrode. Subsequent to annealing and, where used, to external coating, the spark plug electrode tip is placed in a welding fixture. The tip is then aligned with a spark plug electrode and is resistance welded thereto. Similar procedures are preferably performed on both the center and side electrodes of the spark plug. The annealed spark plug electrode tips using the novel alloys according to the invention have a high resistance to attack by lead and other corrosive elements typically present in the combustion chambers of internal combustion engines. A preferred method of making a wear-resistant spark plug is also disclosed.

18 Claims, 4 Drawing Sheets

WEAR-RESISTANT SPARK PLUG ELECTRODE TIP CONTAINING PLATINUM ALLOYS, SPARK PLUG CONTAINING THE WEAR-RESISTANT TIP, AND METHOD OF MAKING SAME

CROSS REFEREE TO RELATED APPLICATIONS

The present application is a continuation-in-part of U.S. patent application Ser. Nos. 09/114,425 and 09/114,448 (now U.S. Pat. No. 5,980,345) both filed Jul. 13, 1998, the disclosures of which are incorporated herein by reference.

BACKGROUND OF THE INVENTION

1. Field of the Invention

The present invention relates to spark plugs for use in internal combustion engines. More particularly, the present invention relates to wear-resistant electrode tips for spark plugs, and to spark plugs containing such wear-resistant tips.

2. Description of the Background Art

Spark plugs are widely used to ignite fuel in internal combustion engines. Spark plug electrodes are subject to intense heat and to a highly corrosive environment generated by the exploding air/fuel mixture. To improve durability and erosion resistance, spark plug electrode tips must be able to withstand the high temperature and corrosive environment resulting from the chemical reaction products between air, fuel, and fuel additives within a combustion chamber.

SAEJ312 describes the specification for automotive gasoline used as a fuel in the United States. The gasoline consists of blends of hydrocarbons derived from petroleum: 50–80 percent saturates, 0–15 percent olefins, and 15–40 percent aromatics. Leaded gasoline contains about 0.10 grams of lead per gallon of fuel (0.026 g Pb/liter), and 0.15 percent sulfur. In unleaded gasoline there is about 0.05 grams of lead per gallon (0.013 g Pb/l), 0.1 percent sulfur, and 0.005 g phosphorous per gallon (0.0013 g P/liter).

In addition, there are a number of additives incorporated into gasoline for various reasons. For example, tetramethyllead (TML) and tetraethyllead (TEL) are added as anti-knock agents. Carboxylic acid compounds such as acetic acid are added as lead extenders. Aromatic amines and phenols are added as antioxidants. Organic bromine and/or chlorine compounds are added as scavengers and deposit modifiers. Phosphors and boron-containing compounds are added to reduce surface ignition, preignition, and as engine scavengers. Metal deactivators are added to reduce oxidative deterioration of fuel by metals, such as Cu, Co, V, Mn, Fe, Cr and Pb. In addition, carboxylic acids, alcohols, amines, sulfonates, and phosphoric acid salts of amines are used as rust-inhibiting additives.

The manufacture of copper (Cu) and nickel (Ni) electrodes for spark plugs is a proven art and has been acccomplished in various ways. For instance, U.S. Pat. No. 3,803,892 describes a method of producing extruded copper and nickel electrodes from a flat plate of the two materials. U.S. Pat. No. 3,548,472 discloses a method of cold-forming an outer nickel cup-shaped sleeve in several steps, inserting a piece of copper wire into the cup, and then lightly pressing the two materials together. U.S. Pat. No. 3,857,145 discloses a process for making a spark plug center electrode in which a central copper core is inserted into a nickel member and attached thereto by a collar portion, to assure that an electrical flow path is produced.

Platimum-4% tungsten (thoriated) alloy was originally developed for spark plug electrodes in aircraft engines by INCO in 1939–1940 to replace platinum-iridium alloys as there was a world shortage of iridium.

The use of certain types of welded-on spark plug electrode tips, which are more wear-resistant than the body of the electrode, is also known. Some of these known welded on spark plug electrode tips are disclosed, for example, in U.S. Pat. Nos. 4,810,220, 4,840,594, and 5,456,624.

Although the use of wear-resistant spark plug electrode tips is known, a need still exists in the art for a spark plug electrode tip made of an improved composition having superior wear-resistant properties

SUMMARY OF THE INVENTION

The present invention provides an improved wear-resistant electrode tip for a spark plug, and a spark plug which incorporates the wear-resistant tip. The improved wear-resistant tip according to the present invention comprises an alloy of platinum, iridium, and tungsten. Surprisingly, by addition of a small amount of tungsten (0.5%–5%) to platinum-iridium alloy, the performance of a resultant spark plug having an electrode tip made of this ternary alloy in internal combustion engines, burning either leaded or unleaded fuel, is greatly improved over the previously known spark plugs. The alloys disclosed in the present specification have excellent workability and weldability, and may be used in current manufacturing processes.

The spark plug electrode tip according to the invention comprises either a sphere or a rivet-shaped portion.

During manufacture, the spark plug electrode tip is annealed in an annealing furnace at a temperature within a range of between abut 900–1400 degrees C. The annealing furnace is preferably either charged with an inert gas such as argon or nitrogen, or is subjected to a vacuum. The spark plug electrode tip is maintained in the furnace for a time period within the range of about 5 to about 15 minutes. This produces an electrode tip having a fine grain microstructure.

The electrode tip hereof is, optionally, further externally coated with platinum or a compatible bonding metal alloy having a thickness from about 8 microns to about 15 microns, most preferably 10–12 microns, before attachment to the electrode. This coating may be applied by electroless plating. In the most preferred embodiment hereof, the coating is applied in three steps, each of which is alternated with an annealing step.

Subsequent to annealing and, where used, to external coating, the spark plug electrode tip is allowed to cool down to, or nearly to room temperature and is then placed in a welding fixture. The tip is then aligned with a spark plug electrode and is resistance welded thereto. Similar procedures are preferably performed on both the center and side electrodes of the spark plug.

The annealed spark plug electrode tips using the novel alloys according to the invention have a high resistance to attack by lead and other corrosive elements typically present in the combustion chambers of internal combustion engines.

A spark plug incorporating the electrode tip hereof has a long life (up to approximately 150,000 miles or more). The spark plug gap established between the two electrodes of the spark plug is maintained substantially constant during the life of the spark plug, since the wear-resistant tip portions at each of the electrodes, between which the spark travels, are substantially unaffected by the gases produced in the combustion chambers of internal combustion engines.

Accordingly, it is an object of the present invention to provide an improved spark plug electrode tip having enhanced wear-resistance as compared with previously known electrode tips.

It is a further object of the present invention to provide a wear-resistant spark plug incorporating the electrode tip hereof.

It is yet a further object of the present invention to provide a wear-resistant spark plug which is usable for an extended period, up to and in excess of 100,000 miles in a vehicle.

It is a still further object of the present invention to provide a method of making a wear-resistant spark plug.

For a more complete understanding of the present invention, the reader is referred to the following detailed description section, which should be read in conjunction with the accompanying drawings. Throughout the present specification and in the claims, all references to percentages are intended to mean percent by weight unless otherwise specified. Throughout the following detailed description and in the drawings, like numbers refer to like parts.

DETAILED DESCRIPTION OF THE PREFERRED EMBODIMENT

Figure 1:
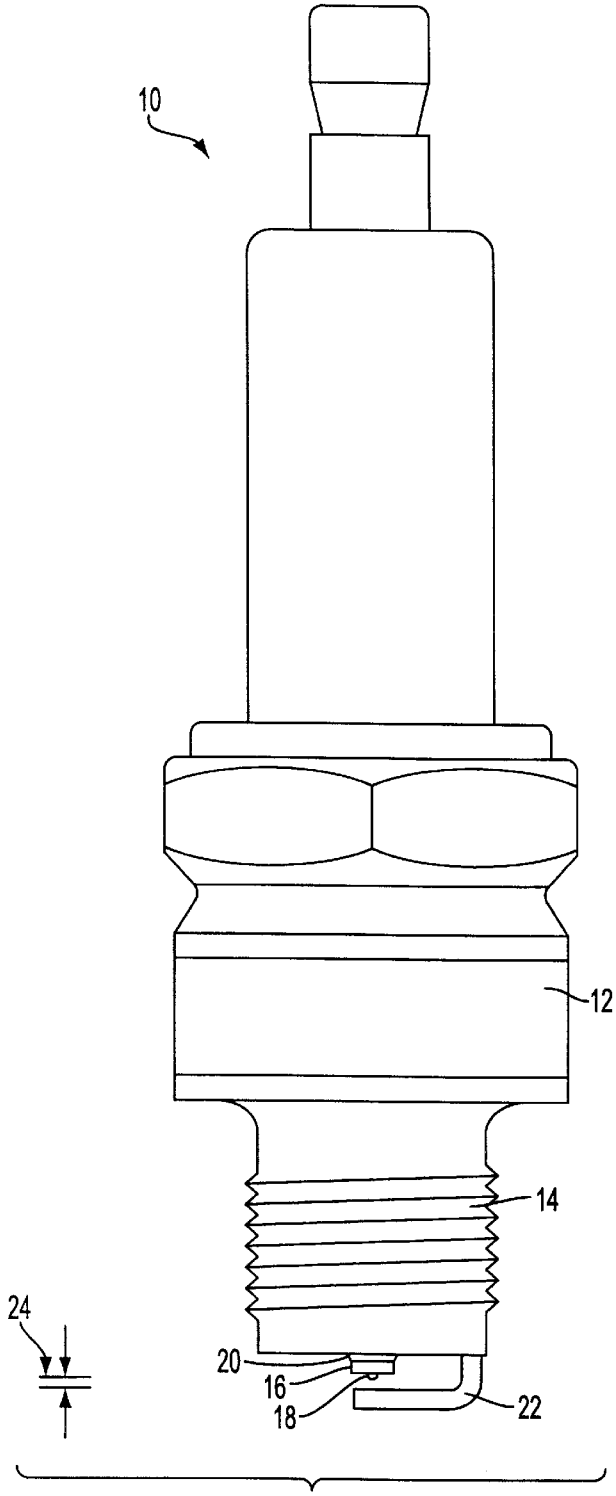
FIG. 1 is a side elevational view of a spark plug in accordance with the present invention, incorporating an annealed tip protion at each of the center and side electrodes thereof.

Referring now to FIG. 1, a spark plug 10 is shown including an annular metal housing 12 having threads 14 formed thereon, a center electrode 16 having an added tip portion 18, an insulator 20 and a side or ground electrode 22. The center electrode 16 is disposed within the insulator 20, which is in turn disposed within the metal housing 12. As is well known, it is desirable to maintain the distance between the tip portion 18 and the side electrode 22, hereinafter referred to as the gap 24, constant over the life of the spark plug 10.

The tip portion 18 has heretofore been manufactured from platinum (Pt), which has been found to provide good resistance to erosion, over time, in the presence of combustion products in a combustion chamber of an internal combustion engine. Nevertheless, the platinum tip portion 18, which is shown in FIG. 1 in the shape of a sphere, is still susceptible to attack by lead, which is present in some fuels still being used with internal combustion engines. The erosion and deterioration of the tip portion 18 can cause the gap 24 to gradually widen, thus weakening the spark that the spark plug 10 produces.

It has been found that iridium (Ir), in combination with platinum in an alloy, increases the wear-resistant properties thereof Surprisingly, it has been found that by adding a small amount of tungsten (0.5%–5%) to a platinum-iridium alloy, the performance of a resultant spark plug having an electrode tip made of this ternary alloy, in internal combustion engines burning either leaded or unleaded fuel, is greatly improved over the previously known spark plugs. Wear-resistance of this ternary alloy, in particular, is significantly improved.

In the preferred embodiments of the present invention, the tip portion may be comprised of any of the following alloys:

(a) from about 75 percent to about 86 percent platinum, from about 12 percent to about 20 percent iridium, and from about ½ percent to about 5 percent tungsten; or (b) from about 76 percent to about 85 percent platinum, from about 14 percent to about 20 percent iridium, and from about ½ percent to about four percent tungsten; or (c) from about 80 percent to about 84 percent platinum, from about 16 percent to about 20 percent iridium, and from about ½ percent to about two percent tungsten; or (d) about 81 percent Pt, about 18 percent Ir, and about 1 percent W; or (e) about 81 percent Pt, about 15 percent Ir, and about 4 percent W.

It will also be appreciated that the amount of iridium, platinum and tungsten can vary significantly, and that the percentages expressed herein could be varied if desired.

Figure 2:
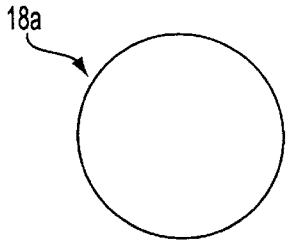
FIG. 2 is a side elevational view of a platinum alloy sphere before same is welded to an electrode of the spark plug.
Figure 3:
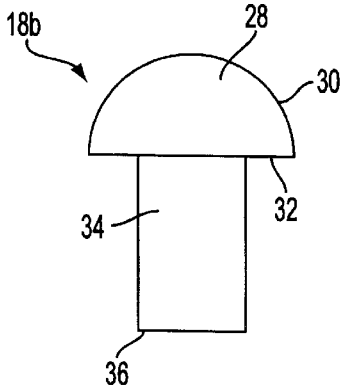
FIG. 3 is a side elevational view of a platinum alloy rivet, in accordance with a preferred embodiment of the present invention, before same is welded to an electrode of the spark plug.

Referring now to FIGS. 2 and 3, there are shown two embodiments of the electrode tip 18 according to the invention. FIG. 2 illustrates the electrode tip in the form of a sphere 18*a* having an outer coating 26 of a bonding metal, which is preferably platinum. The diameter of the sphere 18*a* may vary significantly, but is preferably within the range of about 381 micrometers to about 1.14 mm (0.015–0.045 inch), and more preferably about 760 micrometers (0.030 inch).

FIG. 3 illustrates the electrode tip member in the form of a rivet 18*b*. The rivet 18*b* includes a head 28 having a continuous, semi-spherical outer surface 30 and a flat portion 32. A generally cylindrical shank 33 extends from the flat portion 32 and has a generally flattened base 34.

Figure 4:
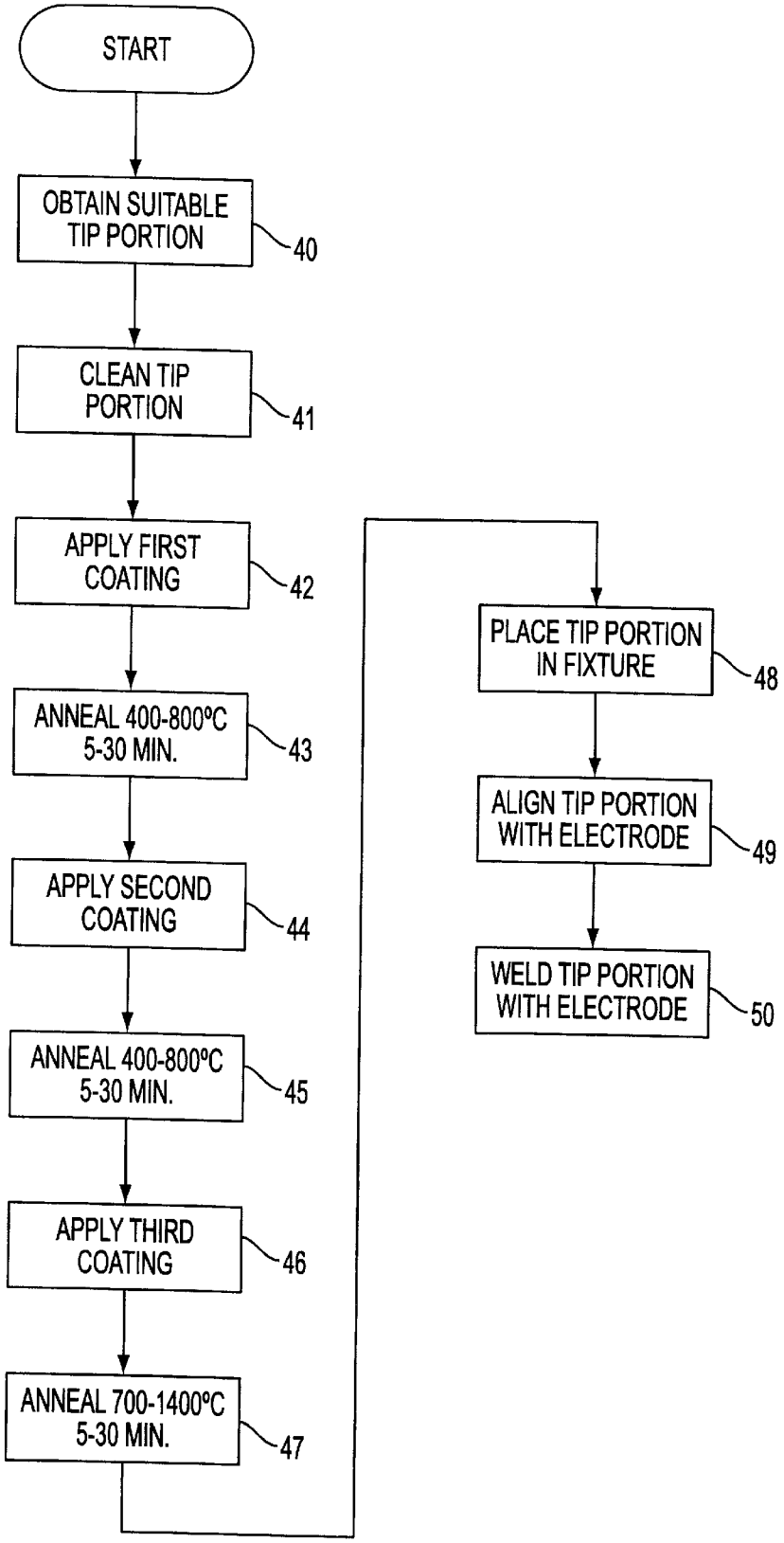
FIG. 4 is a flow chart of the steps used to apply a coating to, to heat treat, and to secure the tip portion to an electrode of a spark plug.

Referring now to FIG. 4, a flow chart 38 illustrates the steps performed in heat-treating and welding the tip member 18 to the electrode 16. Initially, a platinum-iridium-tungsten tip member 18 is obtained, as indicated at step 40. The tip member can be in the form of a sphere or rivet. The tip member 18 may be cold-formed from premanufactured wire which is commercially available from companies such as, for example, Engelhard Corporation of Iselin, N.J., Johnson Matthey of London, England, and Sigmund Cohn Corporation of Mount Vernon, N.Y.

Once the spheres or rivets have been formed, it is preferred, but not required in the practice of the present invention, that they be coated with a layer of a bonding metal which is preferably platinum. The coating may be pure platinum, or an alloy of platinum which is different from the alloy making up the tip member 18. The material chosen for the bonding layer is selected for its physical properties, and particularly for its coefficient of expansion.

The coating applied to each tip member helps to resist welding cracks which might otherwise occur between the electrode and the tip member due to differing coefficients of thermal expansion between the nickel-based electrode and the platinum-iridium-tungsten tip members.

The coating, where used, is applied in a thickness of about 5–15 micrometers, and most preferably, about 10 micrometers. The bonding metal coating, where used, may be applied by electroless plating, a technique in which the object to be coated is soaked in a chemical solution containing metallic salts, in the presence of a chemical reducing agent, and without using any electrical current. Further detail on the electroless plating process may be found in the disclosure of parent application serial number 09/114448, which is incorporated herein by reference.

In a particularly preferred method of making the tip members 18 in accordance with the present invention, they are first cleaned as shown in step 41, which may be accomplished by contacting the tip members 18 with an organic solvent such as acetone. Then, the tip members 18 may have a first coating applied as in step 42, in a thickness in a range of about 1–4 microns. Then, in this preferred method, a first low temperature annealing is done in an annealing oven in a vacuum or in the presence of a substantially inert gas such as argon or nitrogen, at a temperature of 400–700 degrees C., for a period of about 5 to about 30 minutes. This first annealing is shown at step 43 in FIG. 4.

A second coating of bonding material is then placed on the tip member 18, in a thickness ranging from about 2–6 microns, preferably about 4 microns. The second coating is step 44. This second coating is followed by a second low temperature annealing in an annealing oven in a vacuum or in the presence of a substantially inert gas such as argon or nitrogen, at a temperature of 400–700 degrees C., for a period of about 5 to about 30 minutes. The second annealing is shown as step 45 in FIG. 4.

After the second annealing, a third coat of bonding material is placed on the tip member 18 in a thickness ranging from about 2–8 microns, preferably 4–6 microns. The third coating is shown as step 46 in FIG. 4. This third coating is followed by a final annealing at a higher temperature. The third annealing is shown as step 47 in FIG. 4.

Optionally, the coat of bonding material may be applied in a single step and only a single annealing step may be performed, under the conditions described herein for the final annealing.

In the final annealing, the tip members 18 are annealed at temperatures ranging from about 900 degrees C. to about 1400 degrees C in vacuum or in an inert protective atmosphere such as argon and nitrogen for 5 to 15 minutes, as indicated at step 47, to obtain a fine grain microstructure of about 40 micrometers. After annealing is completed, the annealed tip member 18 is removed from the annealing furnace and allowed to cool to room temperature. The annealed tip member 18 exhibits substantially greater resistance to corrosion and erosion as compared with a tip member that has not been annealed.

Figure 5:
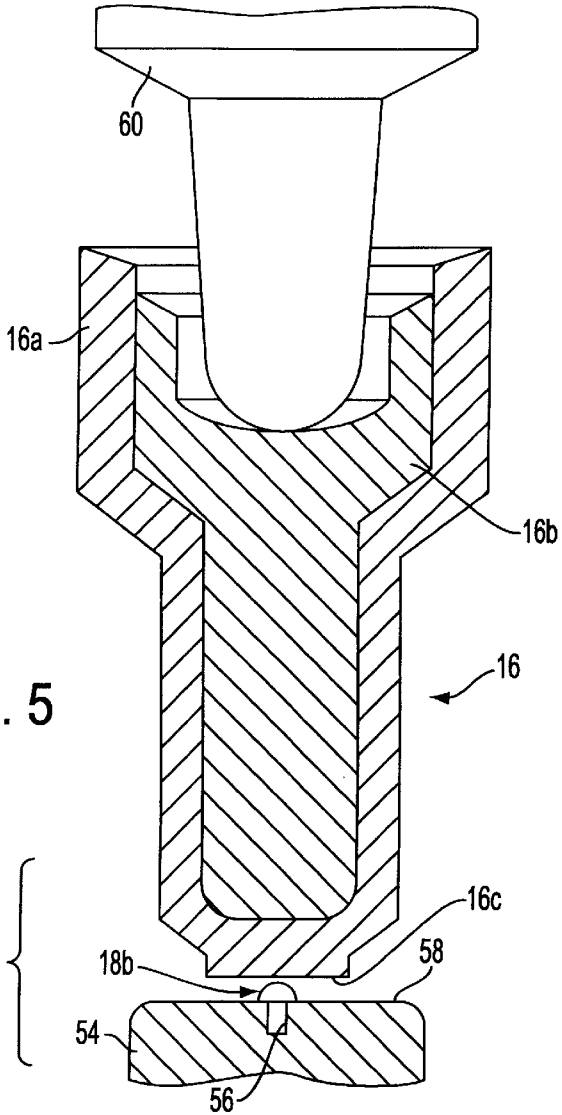
FIG. 5 is a simplified drawing of a welding tool being used to resistance weld the tip portion to the center electrode of the spark plug, where the tip portion comprises a rivet and the spark plug electrode is shown in cross section.

Referring now to FIGS. 4 and 5, where the rivet type of tip member is used, the tip portion 18*b* is now placed in a welding fixture, as indicated at step 48. In FIG. 5, the welding fixture 54 has a recess 56 therein, which is shaped to hold either a spherical or a rivet-shaped tip member 18 on a flat upper surface area 58. The center electrode 16 may be seen to include an outer portion 16*a* made of nickel and a copper core 16*b*. A lower flat surface 16c is positioned to face the hemispherical surface of the rivet-shaped tip member 18*b*.

At step 49 in FIG. 4, the spark plug electrode 16 is aligned with the tip member 18*b*. A welding electrode 60 is then aligned over the spark plug center electrode 16. The tip member 18*b* is then resistance welded to the spark plug electrode as indicated at step 50.

Figure 6:
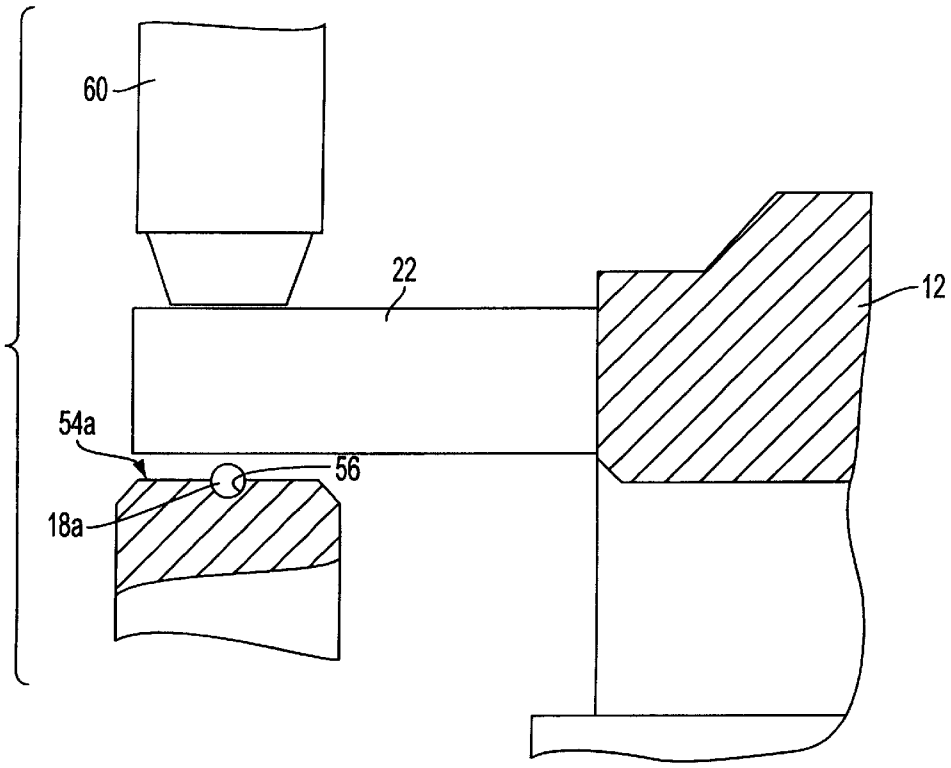
FIG. 6 is a simplified side view, partially in cross section, of a welding tool being used to resistance weld the tip portion to the side electrode of the spark plug, where the tip portion comprises a sphere.

FIG. 6 illustrates a welding fixture 54*a* suitable for holding the spherical tip member 18*a*. FIG. 6 illustrates steps 46–50 for the spherical tip member 18*a* being attached to the ground or side electrode 22 of the spark plug body 12.

Figure 7:
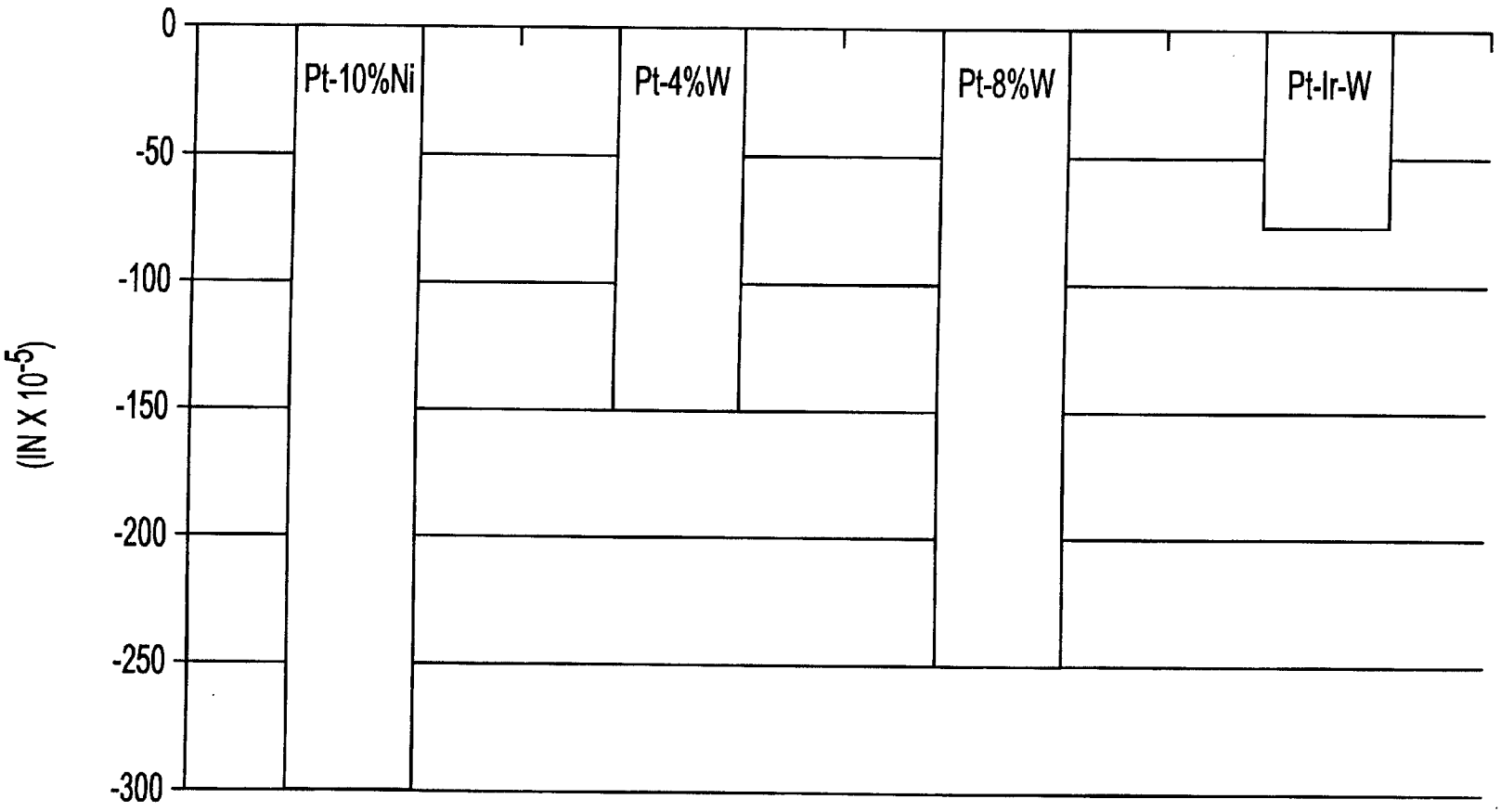
FIG. 7 is a comparative graph of the change in length of sample spark plug electrodes, made of different alloys, in a test engine over a period of 300 hours of standardized dynamometer testing.

The gap growth of a fine grain 80% Pt-20% Ir tipped spark plug after 300 hours of the standard Spark Plug Electrode Accelerated Durability dynamometer test is about three times that of a fine grain 81% Pt-18% Ir-1% W tipped spark plug. The gap growth of a 92% Pt-8% W is also about three times the gap growth of an 81% Pt-18% Ir-1%W tipped spark plug, as evidenced by the graph of FIG. 7. This graph compares the change in length of an electrode after 300 test hours of the dynamometer test on a Ford 2.3 liter dual plug engine burning unleaded fuel. Clearly, the least change in the comparison of FIG. 7 occurred with the Pt—Ir—W alloy, which only decreased by roughly 0.00075 in. over the 300 hour test. This shows that the spark plug electrode tip according to the invention is surprisingly superior to other spark plug electrode tips.

The method of manufacturing described herein enables platinum alloy tip members 18 to be made which are significantly more resistant to erosion than previously developed tip portions.

The annealing performed on the tip portions at the preferred temperature range(s) and preferred time period(s) described herein significantly refines the grain structure, which minimizes the grain boundary erosion and corrosion, and significantly increases its resistance to spark erosion in the presence of lead and other corrosive elements. As a result, the gap is substantially maintained over the life of the spark plug, which may last 100,000 to 150,000 miles in a vehicle, making it possible to use a single set of spark plugs over the useful life of the vehicle in some instances.

The tip portion, wear-resistant spark plug, and method of making same as described herein also does not add appreciably to the cost of making the spark plug, nor does it necessitate the use of materials that are not already widely commercially available. Accordingly, the spark plug 10 of the present invention can still be manufactured economically and without significant added expense.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the claims are intended to be within the scope and spirit of the present invention.

What is claimed is:

1. A wear-resistant spark plug electrode tip for attaching to a spark plug electrode, comprising platinum, iridium, and tungsten.

2. The spark plug electrode tip of claim 1, comprising from about 75 percent to about 86 percent platinum, from about 12 percent to about 20 percent iridium, and from about ½ percent to about 5 percent tungsten.

3. The spark plug electrode tip of claim 1, comprising from about 76 percent to about 85 percent platinum, from about 14 percent to about 20 percent iridium, and from about ½ percent to about four percent tungsten.

4. The spark plug electrode tip of claim 1, comprising from about 80 percent to about 84 percent platinum, from about 16 percent to about 20 percent iridium, and from about ½ percent to about two percent tungsten.

5. The spark plug electrode tip of claim 1, wherein the spark plug electrode tip is substantially spherical.

6. The spark plug electrode tip of claim 1, wherein the spark plug electrode tip is rivet-shaped.

7. The spark plug electrode tip of claim 1, further having a bond coating thereon comprising platinum.

8. The spark plug electrode tip of claim 2, further having a bond coating on the exterior thereof, comprising platinum.

9. The spark plug electrode tip of claim 7, wherein the bond coating is in a range of about 5 microns to about 15 microns in thickness.

10. The spark plug electrode tip of claim 9, wherein said bond coating is a product of a three-stage application process.

11. A spark plug having a center electrode with a first electrode tip according to claim 1 welded thereto; said spark plug further having a side electrode with a second electrode tip according to claim 1 welded thereto.

12. A wear-resistant spark plug electrode tip for attaching to a spark plug electrode, comprising from about 75 percent to about 86 percent platinum, from about 12 percent to about 20 percent iridium, and from about ½ percent to about 5 percent tungsten, said spark plug electrode tip having a bond coating comprising platinum on an exterior surface thereof.

13. A spark plug having an electrode with a wear-resistant tip attached thereto, said tip comprising the tip of claim 12.

14. A method of making a spark plug having an electrode with a wear-resistant tip, comprising the steps of:

a) providing a spark plug electrode tip comprising platinum, iridium, and tungsten;

b) annealing said tip in an annealing oven at 700–1400 degrees C. for a time period in a range of about 5 to about 30 minutes;

c) placing said tip in a welding fixture;

d) aligning an electrode of a spark plug with said tip; and e) welding said tip to said spark plug electrode.

15. The method of claim 14, wherein said spark plug electrode tip is coated with a bond material comprising platinum before being attached to said electrode.

16. The method of claim 15, wherein said coating is applied in three steps, with first and second annealing steps between first and second coating steps.

17. The method of claim 14, wherein said spark plug electrode tip comprises from about 75 percent to about 86 percent platinum, from about 12 percent to about 20 percent iridium, and from about ½ percent to about 5 percent tungsten.

18. The method of claim 17, wherein said spark plug electrode tip is coated with a layer of bonding material comprising platinum before being attached to said electrode.

* * * * *